US010547107B2

(12) United States Patent
Hussain et al.

(10) Patent No.: US 10,547,107 B2
(45) Date of Patent: Jan. 28, 2020

(54) WIDE TUNING RANGE, FREQUENCY AGILE MIMO ANTENNA FOR COGNITIVE RADIO FRONT ENDS

(71) Applicant: King Fahd University of Petroleum and Minerals, Dhahran (SA)

(72) Inventors: Rifaqat Hussain, Dhahran (SA); Mohammad S Sharawi, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 114 days.

(21) Appl. No.: 15/938,487

(22) Filed: Mar. 28, 2018

(65) Prior Publication Data

US 2019/0305423 A1 Oct. 3, 2019

(51) Int. Cl.

| | |
|---|---|
| ***H01Q 1/24*** | (2006.01) |
| ***H01Q 5/10*** | (2015.01) |
| ***H01Q 13/10*** | (2006.01) |
| ***H01Q 21/00*** | (2006.01) |
| ***H01Q 5/50*** | (2015.01) |
| *H01Q 1/38* | (2006.01) |

(52) U.S. Cl.

CPC ..... *H01Q 5/10* (2015.01); *H01Q 5/50* (2015.01); *H01Q 13/10* (2013.01); *H01Q 21/00* (2013.01); *H01Q 1/38* (2013.01)

(58) Field of Classification Search

CPC ..... H01Q 5/10; H01Q 13/10; H01Q 21/00; H01Q 5/50; H01Q 1/38

See application file for complete search history.

(56) References Cited

U.S. PATENT DOCUMENTS

| | | | |
|---|---|---|---|
| 7,924,237 | B2 | 4/2011 | Lai et al. |
| 8,552,913 | B2 | 10/2013 | Ayatollahi et al. |
| 8,803,742 | B2 | 8/2014 | Sharawi et al. |
| 8,957,817 | B2 | 2/2015 | Jiang et al. |
| 9,325,067 | B2 | 4/2016 | Ali et al. |

(Continued)

OTHER PUBLICATIONS

Rouissi et al., I., "Design of Frequency Reconfigurable Multiband Meander Antenna Using Varactor Diode for Wireless Communication," International Journal of Advanced Computer Science and Applications, vol. 8, No. 3, (2017), 159-164.

(Continued)

*Primary Examiner* — Dieu Hien T Duong
(74) *Attorney, Agent, or Firm* — Hauptman Ham, LLP

(57) ABSTRACT

A low profile, 4-element, slot-based, frequency reconfigurable MIMO antenna for cognitive radio (CR) platforms for cellular communication front ends. The antenna is on a board having a top layer substrate and a bottom layer ground plane. The bottom layer ground plane contains four antenna elements, each antenna element having a circular slot and an annular slot spaced outwardly from and extending circumferentially around the circular slot. The bottom layer contains a microstrip feed-line for each antenna element. Varactor diodes on the top layer span the width of each annular slot to tune the resonance frequency over a wide operation band. The antenna covers a wide frequency band from 1800 MHz to 2450 MHz and supports several well-known wireless standards bands, including GSM1800, LTE, UMTS and WLAN, as well as many others.

16 Claims, 4 Drawing Sheets
(4 of 4 Drawing Sheet(s) Filed in Color)

(56) References Cited

U.S. PATENT DOCUMENTS

| | | | | |
|---|---|---|---|---|
| 9,337,537 | B2 | 5/2016 | Hu et al. | |
| 9,531,084 | B2 | 12/2016 | Li et al. | |
| 9,537,223 | B2 | 1/2017 | Hall et al. | |
| 9,553,361 | B2 | 1/2017 | Hu et al. | |
| 9,666,946 | B1 | 5/2017 | Sharawi et al. | |
| 9,698,495 | B2 | 7/2017 | Sharawi et al. | |
| 9,837,702 | B2 | 12/2017 | Sharawi et al. | |
| 2010/0045557 | A1* | 2/2010 | Park | H01Q 1/243 343/770 |
| 2017/0062943 | A1 | 3/2017 | Patron et al. | |
| 2017/0141473 | A1* | 5/2017 | Sharawi | H01Q 9/0442 |
| 2017/0256854 | A1 | 9/2017 | Hu | |

OTHER PUBLICATIONS

Hussain et al., R., "4-Element Planar MIMO Reconfigurable Antenna System for Cognitive Radio Applications," Antennas and Propagation & USNC/URSI National Radio Science Meeting, 2015 IEEE International Symposium on. IEEE, (2015), 717-718.

Cheng et al., S.P., "A Reconfigurable Monopole MIMO Antenna With Wideband Sensing Capability for Cognitive Radio Using Varactor Diodes," Antennas and Propagation & USNC/URSI National Radio Science Meeting, 2015 IEEE International Symposium on. IEEE, (2015), 2233-2234.

* cited by examiner

WIDE TUNING RANGE, FREQUENCY AGILE MIMO ANTENNA FOR COGNITIVE RADIO FRONT ENDS

FIELD OF THE INVENTION

This invention relates generally to the field of wide-band wireless communication systems and consumer electronic devices. More particularly, it relates to reconfigurable multiple-input-multiple-output (MIMO) antenna systems for cognitive radio (CR) platforms for compact wireless devices and LTE mobile handsets. The complete antenna setup can be used in radio frequency based applications, including 4G cellular systems.

BACKGROUND OF THE INVENTION

New trends in modern communication systems have emerged as a result of the growing data rate requirements for modern wireless systems and the need for multi-standard operation in smart wireless devices. The increasing demand of wireless services has made the radio spectrum a very scarce and precious resource. Most current wireless networks characterized by fixed spectrum assignment policies are inefficient, with only 15% to 85% of the licensed spectrum utilized on average.

To meet the high data rate requirements, reconfigurable MIMO antenna systems have gained in popularity over the past few years. This is because of their ability to operate according to the system requirements while keeping the MIMO functionality. A frequency reconfigurable antenna system can operate in MIMO configuration to enhance the system throughput and can support multiple wireless standards by switching its operation across different frequency bands. Thus, it helps to mitigate the spectrum congestion by efficiently utilizing the spectrum resources, which is the prime purpose of a CR platform.

CR is an adaptive, intelligent radio and network technology that can automatically detect available channels in a wireless spectrum and change transmission parameters enabling more communications to run concurrently and also improve radio operating behavior. The major advantage of a CR technique is its ability to utilize the idle or under-utilized spectrum resources. CR uses a number of technologies including Adaptive Radio (where the communications system monitors and modifies its own performance) and Software Defined Radio (SDR) where traditional hardware components including mixers, modulators and amplifies have been replaced with intelligent software.

Frequency reconfigurable MIMO antennas are the key front-end in a CR antenna system. Frequency agile MIMO slot antennas are suitable to be used as CR front-end antennas because of several advantages they offer. In addition to their capability to enhance system throughput, they are also easy to fabricate and are compatible with other microwave integrated circuits.

To enhance the capacity of a multiband or wideband communication system, it is necessary to implement reconfigurable characteristics in the system. These topologies are used to efficiently utilize the available frequency spectrum. The concept of CR is all about efficient frequency spectrum use. A CR based system has the ability to sense unoccupied frequency bands and has switching capability to change the operating point with increased data reliability and channel capacity. Moreover, MIMO technology is increasing in popularity because it provides high data rates with increased range and reliability. MIMO antennas are being utilized in 4G wireless standards.

Frequency agile antennas are an essential component of CR platforms. For efficient spectrum utilization, it is highly desirable to have antennas with wide-band operation or which can switch across several frequency bands. Reconfigurability is the fundamental requirement for CR applications in wireless devices. In addition, reconfigurable MIMO antenna systems are widely adopted in current communication systems to achieve the high data rate requirements within the available limited power and bandwidth channels. The key feature of a MIMO antenna system is its ability to multiply data throughput with enhanced data reliability, using the available bandwidth and hence resulting in improved spectral efficiency.

Exemplary prior includes the systems disclosed in issued U.S. Pat. No. 9,537,223 to Hall et al. and U.S. Pat. No. 8,957,817 to Jiang et al., and in published US patent application 2017/0062943 to Patron et al.

Hall et al. (U.S. Pat. No. 9,537,223) disclose a reconfigurable multi-output antenna (16) that comprises one or more radiating elements (12, 14), at least two matching circuits (42, 44, 50, 52) coupled to the or each radiating element (12, 14) via e.g. a splitter (30, 32) or a duplexer; and wherein each matching circuit (42, 44, 50, 52) is associated with a separate port (38, 40, 46, 48) arranged to drive a separate resonant frequency so that the or each radiating element (12, 14) is operable to provide multiple outputs simultaneously. Each matching circuit may be reconfigurable to enable their respective ports to tune their outputs to different frequencies. The matching circuits may comprise one or more than one inductor or capacitor (e.g. in the form of an L-C circuit) and may comprise a variable capacitor (i.e. varactor). (See figures and col. 10, lns. 47-col. 11, lns. 49).

Jiang et al. (U.S. Pat. No. 8,957,817) disclose a wireless communication system which is both miniaturized and reconfigurable. The antenna is a CPW (coplanar wave guide) square-ring slot antenna which is miniaturized and reconfigurable by the integration of ferroelectric (FE) BST varactors at the back edge of the inner conductor, or patch, of the antenna. The frequency of the antenna is reconfigurable due to the tunable capacitance of the FE varactors. (See figures and summary).

Patron et al. (2017/0062943) disclose a reconfigurable leaky-wave antenna that includes a plurality of cascaded metamaterial unit cells where each cell has a complementary resonator in its ground plane and adjustable varactor diodes that are biased to change a propagation constant through the plurality of cascaded metamaterial unit cells so that a directive beam from the antenna can be steered around an azimuth plane. (See figures and [0012]-[0014]).

To applicant's knowledge, no one has developed a compact, MIMO antenna for CR platforms for cellular communication front ends, wherein the antenna is frequency agile and has a wide tuning range covering several well-known wireless standards, including, among others, GSM1800, LTE, UMTS and WLAN.

Accordingly, there is need for a compact, MIMO antenna for CR platforms for cellular communication front ends, wherein the antenna is frequency agile and has a wide tuning range covering several well-known wireless standards, including, among others, GSM1800, LTE, UMTS and WLAN.

SUMMARY OF THE INVENTION

The present invention is a compact, frequency-agile, MIMO antenna for CR platforms for cellular communication front ends, wherein the antenna has a wide tuning range covering several well-known wireless standards and enables switching between operating bands in CR platforms.

Slot-reconfigurable antennas are integrated in the CR platform and continuous frequency tuning is achieved using varactor diodes. Frequency-reconfigurable MIMO antenna systems combine the advantages of high throughput capability and the ability to switch between several bands/standard coverage.

The invention uses a low profile, 4-element, slot-based, frequency reconfigurable MIMO antenna. The MIMO antenna is on a board having typical smart phone dimensions. The proposed antenna covers a wide frequency band from 1800 MHz to 2450 MHz and supports several well-known wireless standards bands, including GSM1800, LTE, UMTS and WLAN, as well as many others.

The proposed antenna design can be tuned to other frequency bands by choosing different sizes of the annular slot. The antenna design is miniaturized by loading the slot using reactive impedance. With the invention, four antenna elements are accommodated in a small area. At least a 50% size reduction is obtained at the lowest resonating band, and the 4-element MIMO antenna system is realized on board dimensions of 60×120×0.76 $mm^3$. Furthermore, the proposed antenna elements exhibited a tiled radiation pattern that helped in lowering the field coupling between antenna elements and hence enhanced the MIMO performance.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing, as well as other objects and advantages of the invention, will become apparent from the following detailed description when taken in conjunction with the accompanying drawings, wherein like reference characters designate like parts throughout the several views, and wherein:

FIG. 1(*b*) shows the geometry of the bottom layer in the 4-element slot MIMO antenna system of the invention.

DETAILED DESCRIPTION OF THE PREFERRED EMBODIMENTS

Figure 1A:
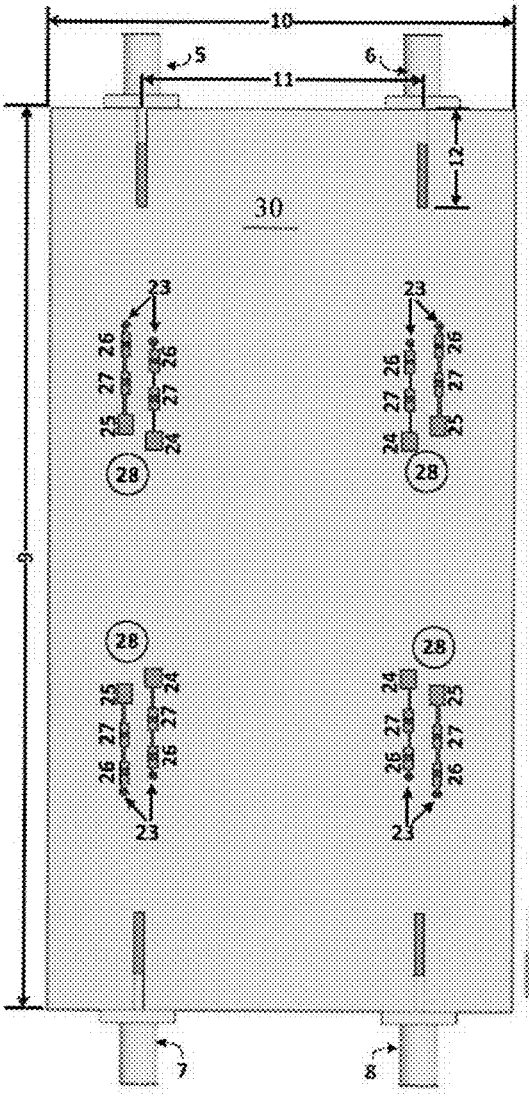
FIG. 1(*a*) shows the geometry of the top layer in the 4-element slot MIMO antenna system according to the invention.
Figure 1B:
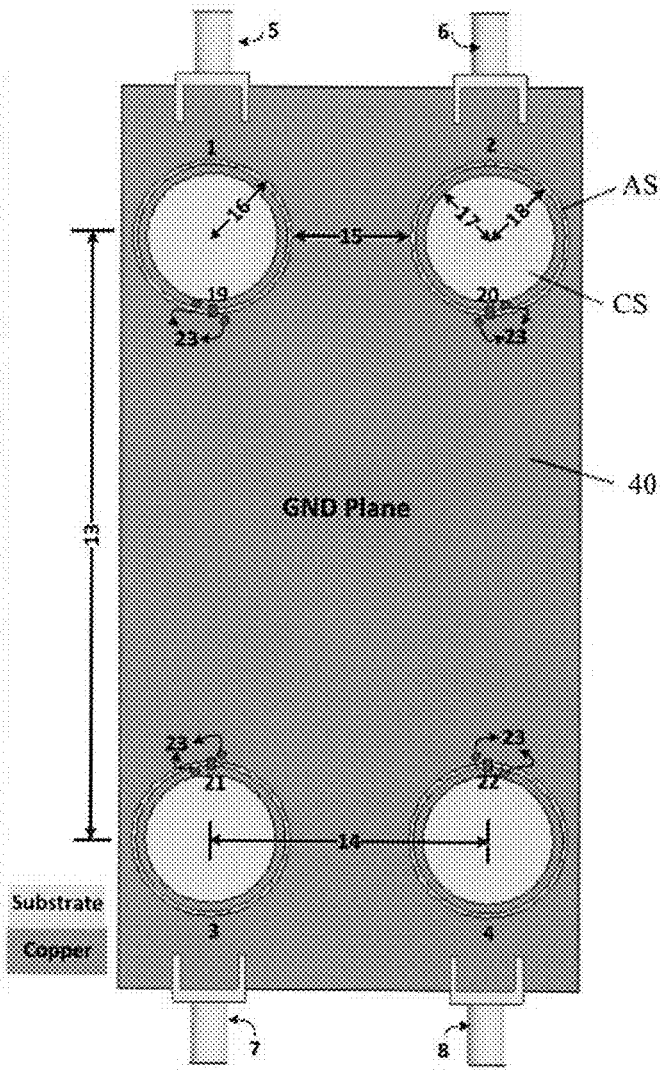

The geometry of the proposed 4-element, slot-based MIMO antenna system is shown in FIGS. 1(*a*) and 1(*b*), with FIG. 1(*a*) showing the top layer and FIG. 1(*b*) showing the bottom layer. The antenna is designed on a Rogers RO4350 substrate with a relative permittivity ($\varepsilon_r$) of 3.48, loss tangent of 0.0036 and a board thickness of 0.76 mm. All antenna elements of a single design are similar in structure.

Figure 2:
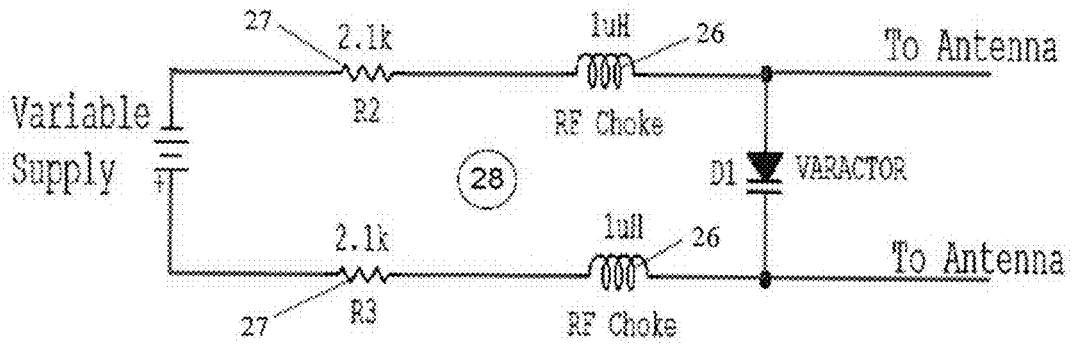
FIG. 2 shows the biasing circuit schematic for a varactor diode for a single antenna element in the antenna system of FIGS. 1(*a*) and 1(*b*).
Figure 3:
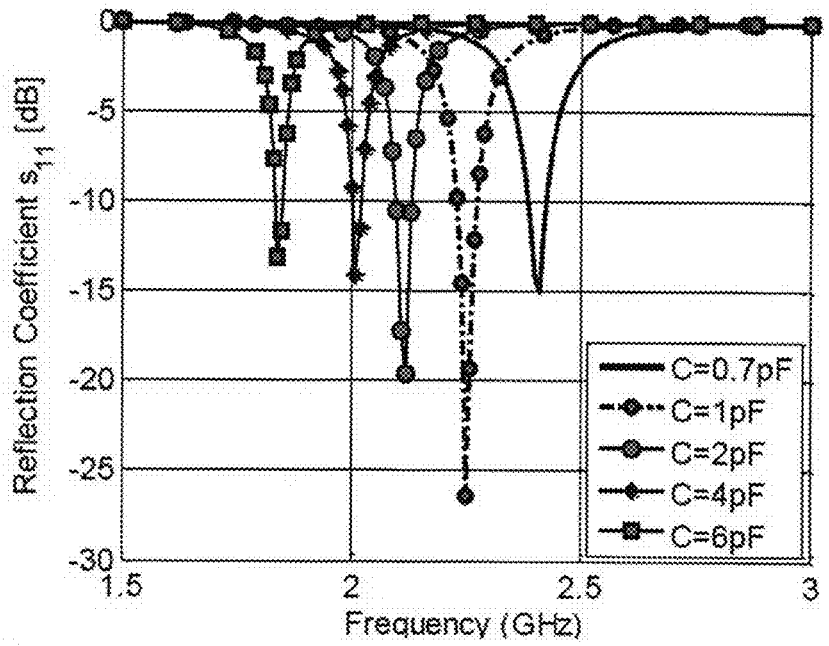
FIG. 3 shows the simulated reflection coefficients for the antenna system.
Figure 4:
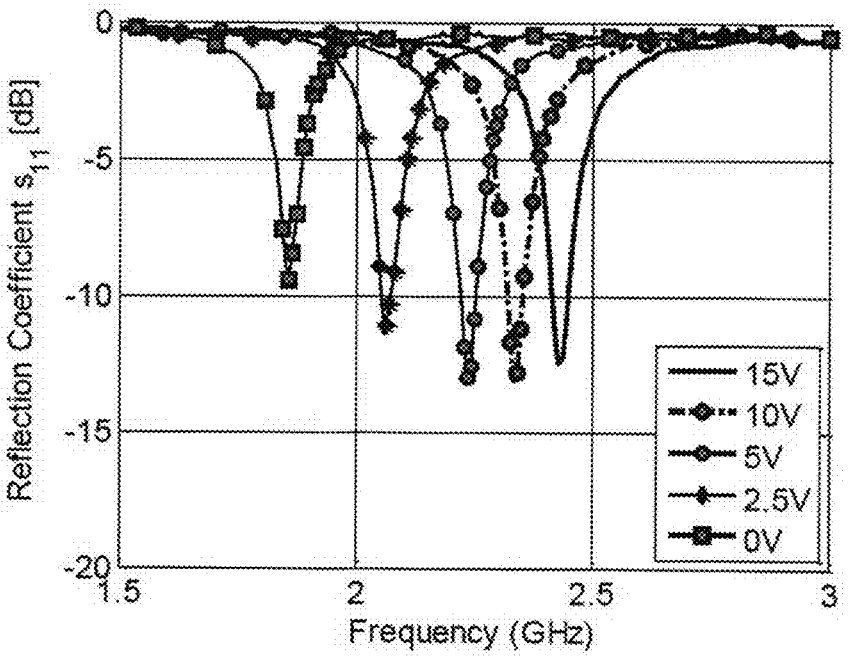
FIG. 4 shows the measured reflection coefficients.
Figure 5:
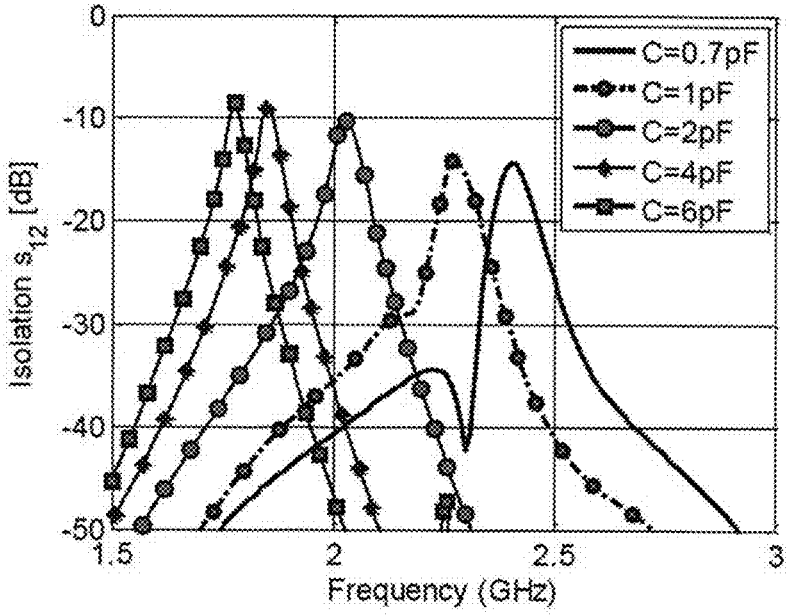
FIG. 5 shows the simulated isolation curves for the antenna system of the invention.
Figure 6:
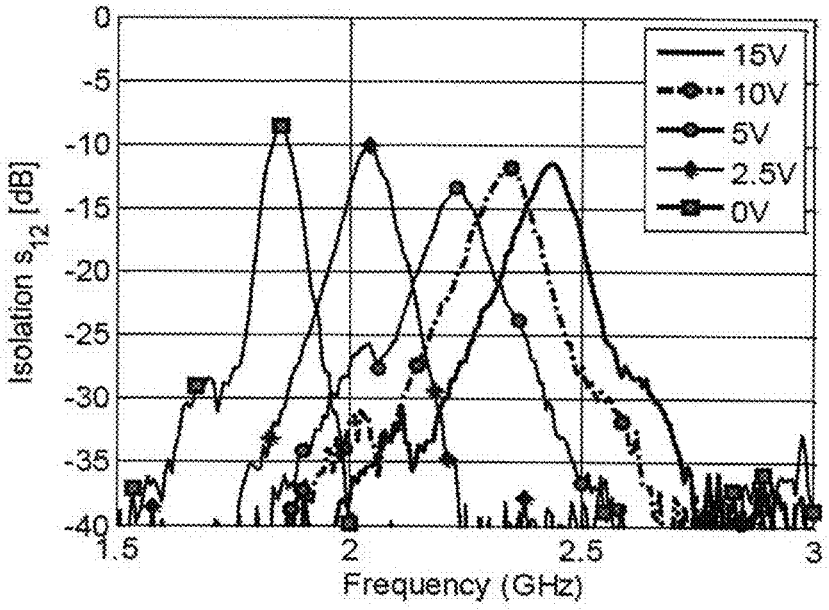
FIG. 6 shows the measured isolation curves for the antenna system of the invention.
Figure 7A:
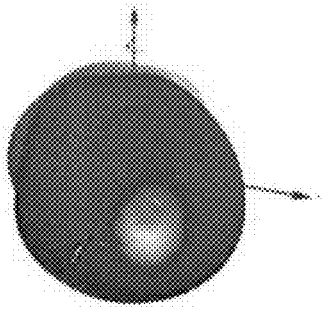
FIGS. 7(*a*) through 7(*d*) show the gain patterns for the four antenna elements at 2,000 MHz.
Figure 7B:
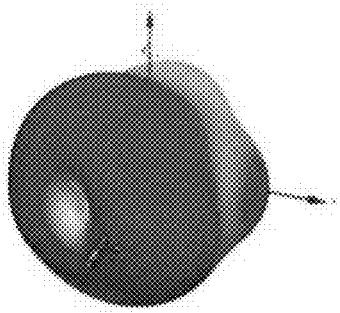
Figure 7C:
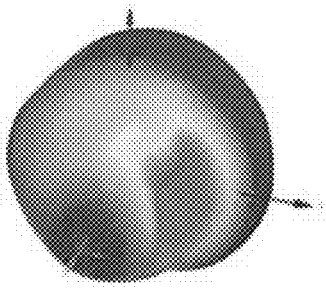
Figure 7D:
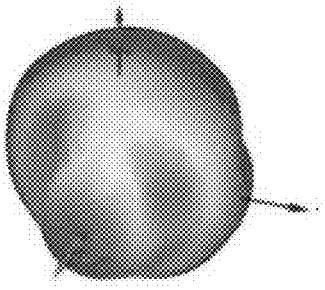
Figure 8:
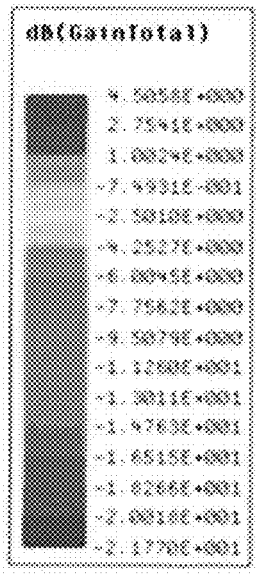
FIG. 8 is a chart showing the colors used in FIGS. 7(*a*) through 7(*d*) for different gains.

As seen best in FIG. 1(*a*), the top layer 30 of the antenna system contains a microstrip feed-line 12 and varactor diode biasing circuitry 28 for each diode. Reconfigurability is achieved by using the varactor diodes to tune the resonance frequency over a wide operation band. The complete biasing circuit schematic 28 for a varactor diode for a single antenna element is shown in FIG. 2. The board used in the top layer in the particular example disclosed herein has a length dimension 9 of 120 mm and a width dimensions 10 of 60 mm.

The bottom layer 40 contains four annular slot, reconfigurable MIMO antenna elements 1, 2, 3 and 4, respectively, fed via system input SMA connectors 5, 6, 7 and 8, respectively. A single antenna element consists of a circular slot CS having a radius 17 of 8.5 mm, and an annular slot AS having a radius 18 of 10.1 mm. The slot AS has a width of 0.5 mm (radius 16 minus radius 18—see FIG. 1(*b*)).

The varactor diodes 19, 20, 21 and 22 are placed so that they span the width of the outer annular slot AS and are used to load the antenna by reactive capacitance. The diodes connect the inner and outer edges of the annular slot and thus bridge the slot with capacitive reactance. The varactor diode terminals, on the GND plane 40, are connected with the associated biasing circuit 28 using two shorting posts 23 as shown on the bottom layer. The GND plane layer 40 acts as a co-planar reflector for the MIMO antenna elements, enabling beam tiling and thus lowering the field coupling for better MIMO performance.

As shown in FIG. 2, the biasing circuitry 28 for each antenna element consists of an RF choke 26 of 1 μH and 2.1 kΩ resistors 27 connected to the two terminals of the respective varactor diodes 19, 20, 21 and 22. The varactor diodes are reverse biased by applying a variable voltage source across positive terminal 24 and GND pad 25. An identical biasing circuitry is used to bias each of the varactor diodes. The diodes are utilized to tune the resonance frequency over a wide operation band.

The SMA connectors 5, 6 and 7, 8 at the ends of the board are spaced apart a distance 11 of 36 mm. The longitudinal spacing 13 between the centers of the circular slots CS at one end of the board and the centers of the circular slots at the opposite end is 80 mm. The lateral spacing 14 between the centers of the circular slots at each end of the board is 36 mm, and the lateral spacing 15 between the annular slots AS at each end of the board is 15.5 mm. As noted previously, each annular slot has a width of 0.5 mm. The board has a thickness of 0.76 mm and the dielectric constant of the substrate is $\varepsilon_r$=3.48. The varactor diodes used are SMV 1233.

For antenna operation, the varactor diode reverse bias voltage is varied between 0~15 volts. The capacitance of a varactor diode has a significant effect on its resonating frequency. When the resonating frequency is smoothly changed over the frequency band 1800~2450 MHz, the capacitance of the diode varies from 0.7 pF to 6 pF. A significant bandwidth is thus achieved at all resonating bands. The minimum −6 dB operating bandwidth is 40 MHz.

The gain patterns for the four antenna elements at 2000 MHz is shown in FIGS. 7(*a*) through 7(*d*). The 3D gain patterns of the antenna system of the invention were computed using HFSS. Note the tilting in the gain patterns that can provide enhanced MIMO features with its low correlation coefficient.

As can be seen, the antenna system of the invention is slot-reconfigurable and continuous frequency tuning is achieved using varactor diodes. Frequency-reconfigurable MIMO antenna systems combine the advantages of high throughput capability and the ability to switch between several bands/standard coverage. The covered bands can be changed according to the design requirements by changing the slot width, inter-slot spacing, etc. The very wide bandwidths obtained are essential for future wireless standards to support higher data rates as well as backward compatibility with current standards.

While the invention has been described in connection with its preferred embodiments, it should be recognized that changes and modifications may be made therein without departing from the scope of the appended claims.

What is claimed is:

1. A frequency-reconfigurable, multiple-input-multiple-output antenna system for cognitive radio platforms, wherein the antenna system has a wide tuning range covering several wireless standards and that enables switching between operating bands in cognitive radio platforms, said antenna system comprising:

a board having a top layer substrate and a bottom layer ground plane, said bottom layer ground plane containing four antenna elements;

each said antenna element comprises a circular slot and an annular slot spaced outwardly of and extending circumferentially around the circular slot;

said top layer substrate overlying the bottom layer ground plane and contains a microstrip feed-line for each said antenna element; and a varactor diode positioned on the top layer to span the width of each said annular slot in the bottom layer to tune the resonance frequency over a wide operation band.

2. The frequency-reconfigurable antenna system as claimed in claim 1, wherein:

said top layer substrate has a relative permittivity ($\varepsilon_r$) of 3.48, a loss tangent of 0.0036 and a board thickness of 0.76 mm.

3. The frequency-reconfigurable antenna system as claimed in claim 2, wherein:

the microstrip feed lines comprise SMA connectors.

4. The frequency-reconfigurable antenna system as claimed in claim 3, wherein:

the board has a length dimension of 120 mm and a width dimension of 60 mm.

5. The frequency-reconfigurable antenna system as claimed in claim 4, wherein:

the circular slots each have a radius of 8.5 mm; and the annular slots each have a radius of 10.1 mm and a width of 0.5 mm.

6. The frequency-reconfigurable antenna system as claimed in claim 5, wherein:

the varactor diodes each have terminals connected with a respective biasing circuit via two shorting posts on the bottom layer ground plane.

7. The frequency-reconfigurable antenna system as claimed in claim 6, wherein:

the varactor diodes spanning the width of the annular slots load the antenna by reactive capacitance.

8. The frequency-reconfigurable antenna system as claimed in claim 7, wherein:

the bottom layer ground plane acts as a co-planar reflector for the multiple-input-multiple-output antenna elements, enabling beam tiling and thus lowering the field coupling for better multiple-input-multiple-output performance.

9. The frequency-reconfigurable antenna system as claimed in claim 8, wherein:

the multiple-input-multiple-output antenna is on a board having typical smart phone dimensions of 60 mm width, 120 mm length and 0.76 mm thickness.

10. The frequency-reconfigurable antenna system as claimed in claim 9, wherein:

the antenna system covers a wide frequency band from 1800 MHz to 2450 MHz and supports several wireless standards bands, including GSM1800, LTE, UMTS and WLAN.

11. The frequency-reconfigurable antenna system as claimed in claim 10, wherein:

the bottom layer ground plane and top layer substrate have substantially the same overall length and width dimensions.

12. The frequency-reconfigurable antenna system as claimed in claim 11, wherein:

said biasing circuitry consists of two 1 μH RF chokes and two 2.1 kΩ resistors connected in parallel to two terminals of the varactor diodes, said varactor diodes being reverse biased by applying variable voltage.

13. The frequency-reconfigurable antenna system as claimed in claim 12, wherein:

the varactor diodes used are SMV 1233.

14. The frequency-reconfigurable antenna system as claimed in claim 13, wherein:

the varactor diode reverse bias voltage is varied between 0~15 volts.

15. The frequency-reconfigurable antenna system as claimed in claim 14, wherein:

resonating frequency is smoothly changed over the frequency band 1800~2450 MHz.

16. The frequency-reconfigurable antenna system as claimed in claim 15, wherein:

capacitance of said varactor diodes is varied from 0.7 pF to 6 pF.

* * * * *